US005291643A

United States Patent [19]

Boeglin

[11] Patent Number: 5,291,643

[45] Date of Patent: Mar. 8, 1994

[54] SYSTEM FOR POSITIONING AND MAINTAINING A PLATE UPON A SURFACE

[75] Inventor: Francis Boeglin, Erstein, France

[73] Assignee: Steelcase Strafor (S.A.), Strasbourg, France

[21] Appl. No.: 985,101

[22] Filed: Dec. 3, 1992

[30] Foreign Application Priority Data

Jul. 2, 1992 [EP] European Pat. Off. ..... 92 440081.5

[51] Int. Cl.[5] ..... A47B 47/04; B23Q 7/04

[52] U.S. Cl. ..... 29/283; 297/440.1; 297/440.13; 312/195; 312/257.1

[58] Field of Search ..... 29/700, 270, 271, 281.6, 29/283; 312/194, 195, 196, 257.1; 297/440, 442

[56] References Cited

U.S. PATENT DOCUMENTS

| | | | |
|---|---|---|---|
| 3,575,465 | 4/1971 | Dolby et al. | 297/442 X |
| 3,881,428 | 5/1975 | Klecki | 312/195 X |
| 4,169,639 | 10/1979 | Zola | 297/440 X |
| 4,300,455 | 11/1981 | Ornati | 297/440 X |
| 4,755,000 | 7/1988 | Chiaro et al. | 297/443 X |
| 4,966,421 | 10/1990 | Mengel | 312/195 |
| 5,112,110 | 5/1992 | Perkins | 297/443 X |

FOREIGN PATENT DOCUMENTS

0504533A1 9/1992 European Pat. Off. .

*Primary Examiner*—Timothy V. Eley
*Attorney, Agent, or Firm*—Mason, Fenwick & Lawrence

[57] ABSTRACT

A system for positioning and maintaining in place an horizontal plate upon an horizontal surface such as the upper face of a rest block, typically when such plate and such block are elements of a modular furniture system, characterized in that the components of said positioning system are not visible on any of said plate surfaces, which enables said plate to be reversible.

8 Claims, 3 Drawing Sheets

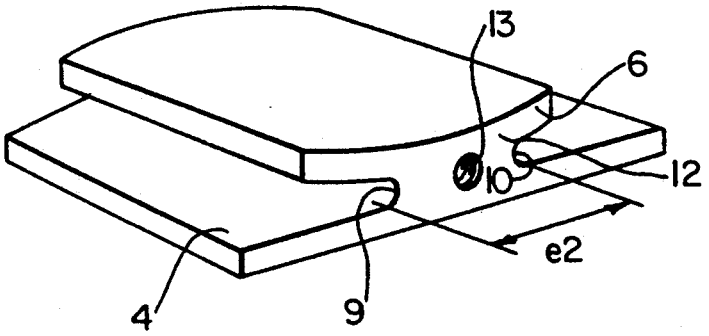
FIG. 4
FIG. 5
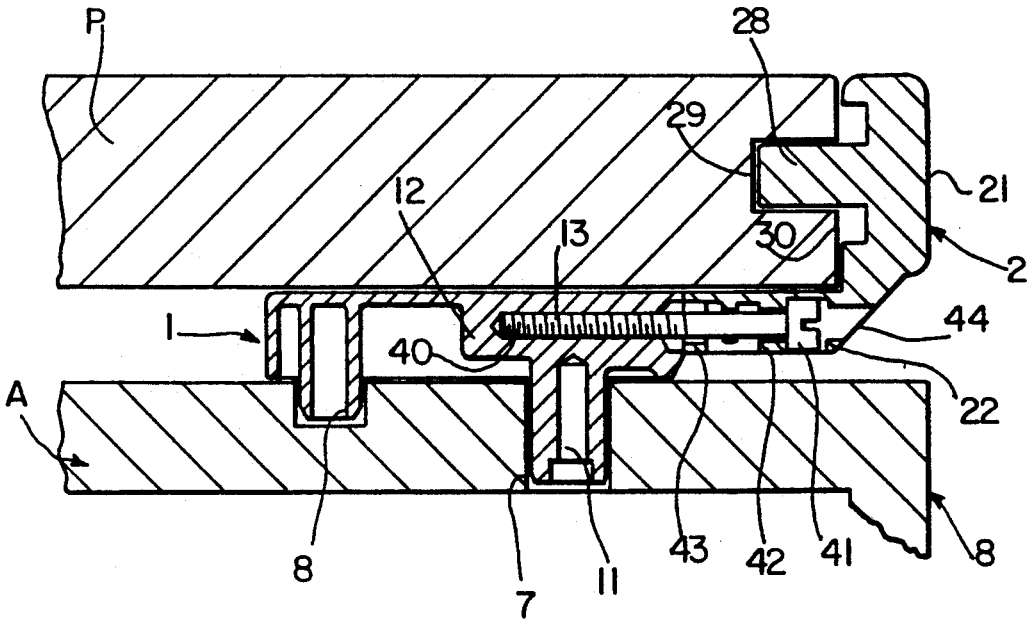

SYSTEM FOR POSITIONING AND MAINTAINING A PLATE UPON A SURFACE

BACKGROUND OF THE INVENTION

1. Field of the Invention

This invention relates to a new and improved system for positioning and maintaining a horizontal plate upon a horizontal surface such as the upper face of a rest element, typically when such plate and such rest element are pieces of a modular furniture system, the main advantage of said positioning system of the invention being that its pieces do not affect the plate surfaces so that said plate can be used upside down at will without showing any element of the system.

2. Related Art

A modular furniture system of this kind is described in the EP-A-91440021.3 of the applicant. In such system it is common to position and maintain a plate upon its rest block with studs/cups couples provided respectively on each face of the plate and on the upper face of the rest block or with bolts passing through the plate to engage a housing in the block.

However, one advantage of this system is the possibility for an angular plate to be turned upside down to invert the orientation thereof, to obtain large working surfaces of sineous shape, but inasmuch said positioning means must be present on both faces, which affects the aesthetics of the assembly, the non-used means remaining visible on the upper face of the plate.

This invention eliminates this drawback with a new system for efficiently positioning and maintaining a plate upon a horizontal support by acting only laterally upon the plate, i.e. only the edge of the plate without affecting any part of the working surface, whatever its orientation.

SUMMARY OF THE INVENTION

To this end, in the upper face of the rest block, in the vicinity of at least one edge, is mounted a first intermediary fixed piece, a shoe having on two opposite sides horizontal grooves parallel mutually and to said upper face, and perpendicular to said edge, and a second movable intermediary fork piece shaped as a horizontal fork mounted slidably into said grooves and having a vertical heel-shaped semi-cylindrical portion having the dimensions and shape of a corresponding recess in the plate edge, so that said recess in the plate edge receives exactly said heel of the fork with the panar face thereof being level with the edge plane of the plate.

Preferably assembly of the shoe and fork pieces is made integral by a screw passing through the movable fork and screwed into the shoe parallel to its grooves. Accordingly, said screw joins both pieces and locks the whole system in place, including the plate and the rest block. By unscrewing the screw, the fork can easily be drawn rearwardly out of the plate recess, whereas it would have been difficult to grip it to remove the plate.

Preferably, the inventive positioning system connects a plate and a resting block leaving a space of about 10–15 mm between the plate and the upper face of the rest block to provide a better stability to the plate. Preferably, a number of blocks of flexible material of the same height are placed around the shoe of the system.

To secure the shoe against rotation, and consequently to keep the grooves thereof properly perpendicular to the plate edge, the shoe comprises an auxiliary anchoring element engaging the upper face of the rest block, e.g. a pin inserted into said upper face of the rest block.

Similarly to prevent any accidental incorrect positioning of the vertical heel in the recess of the plate edge, said heel is provided with an auxiliary anchoring element such as a pin inserted into the face of said recess of the plate edge.

The advantages of the positioning system of the invention are numerous.

Firstly, it comprises practically no element normally visible from the outside. The only non-concealed piece is the semi-cylindrical heel of the intermediary movable fork when in place in the recess of the plate edge. However, the planar rear face is the only visible portion of the fork and is on a level with the edge surface, so that said surface appears practically uninterrupted, except of course when, for purely aesthetic purposes, the colors of the plate surfaces and of the heel are differently selected.

The surface of the plate does not show any element of the system, so that according to an essential feature of the invention, said system brings the opportunity to use either side of a plate by merely turning the plate upside down.

Reversibility of the plate enables the creation of various furniture assemblies as already suggested in EP-A-91440021.3. However, it should be noted that no other positioning and maintaining system enables such a reversibility without affecting the plate appearance, inasmuch all known systems are using means which modify said appearance.

In addition, the present system is an extremely strong construction and from this point of view it meets all international regulations. It is of high simplicity, as well as for its mounting as for its dissembling, using only one screw to be rotated in one direction or the other, said screw being not visible from the outside.

BRIEF DESCRIPTION OF THE DRAWINGS

The invention is now described in detail with reference to the attached drawings.

FIG. 4 is a perspective view of the fixed intermediate piece of "shoe".

FIG. 5 shows the screw mechanism used for blocking the installed system and reversely to extract the movable piece.

DETAILED DESCRIPTION OF THE PREFERRED EMBODIMENTS

Figure 1:
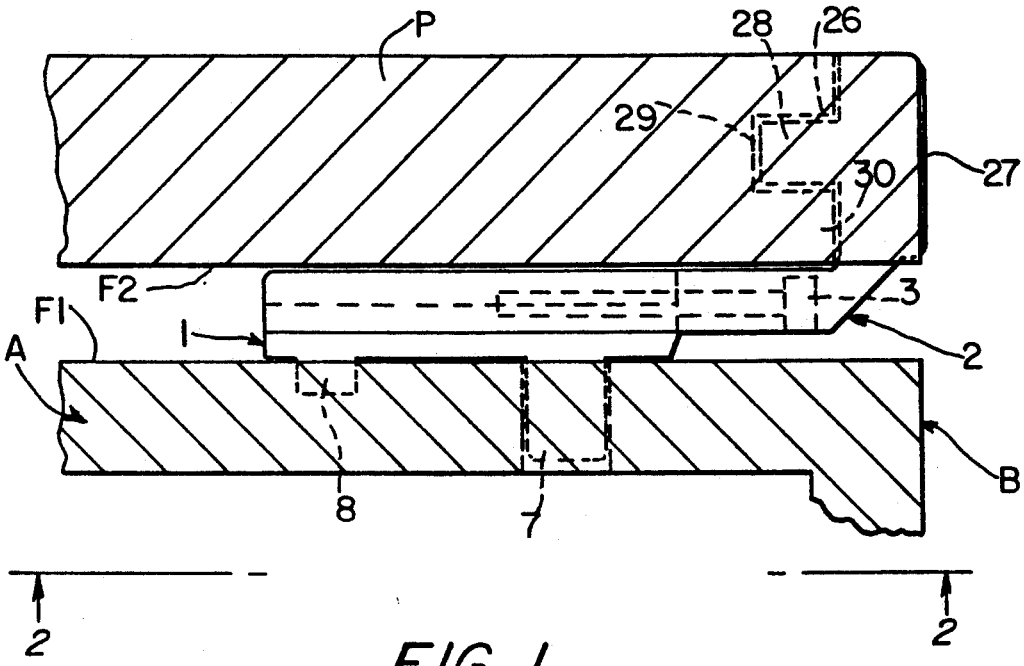
FIG. 1 is a schematic vertical section of the present system as used for positioning and maintaining a plate upon a rest block.

The system of this invention is used to position and maintain a plate P such as a working surface upon a rest block A such as a storage box of a modular furniture assembly.

It comprises a first fixed intermediate piece or "shoe" having the general numeral (1) and a second movable intermediate piece or "fork" having the general numeral (2) which cooperate one with the other and with plate P and block A, the assembly being locked with a screw mechanism having the general numeral (3).

Referring particularly to FIG. 4, it is shown that shoe (1) comprises a base plate (4) preferably in molded metal such as "ZAMAK" strengthened with ribs (5) and an upper plate or bearing plate (6), also made of "ZAMAK", said base plate having on its lower face two studs (7) and (8). The bearing plate (6) is connected to the base plate (4) through a connecting portion shaped with two parallel grooves (9) and (10) which are parallel to axis XX' joining the studs (7) and (8) axis, and which is, as shown on FIG. 2, perpendicular to the edge B of plate P. Stud (7) has a diameter substantially larger than stud (8) and it has an internal bore (11), smooth and adapted to receive a self-tapping screw.

In the stud (7) area, the base plate (4) has an extra-thickness (12) in which is provided an horizontal internal thread (13) for the screw mechanism (3) as it shall be described hereunder.

As shown particularly on FIG. 1, said shoe (1) is located upon upper face $F_1$ of block A, each stud (7) and (8) being forced into a corresponding hole in said block A, a locking screw (not shown) being screwed through the upper block wall and in the bore (11) of stud (7). The second stud (8) prevents any accidental rotation of shoe (1) around stud (7), which would adversely affect the proper orientation of grooves (9), (10), which must remain perpendicular to edge B of plate P.

Figure 3A:
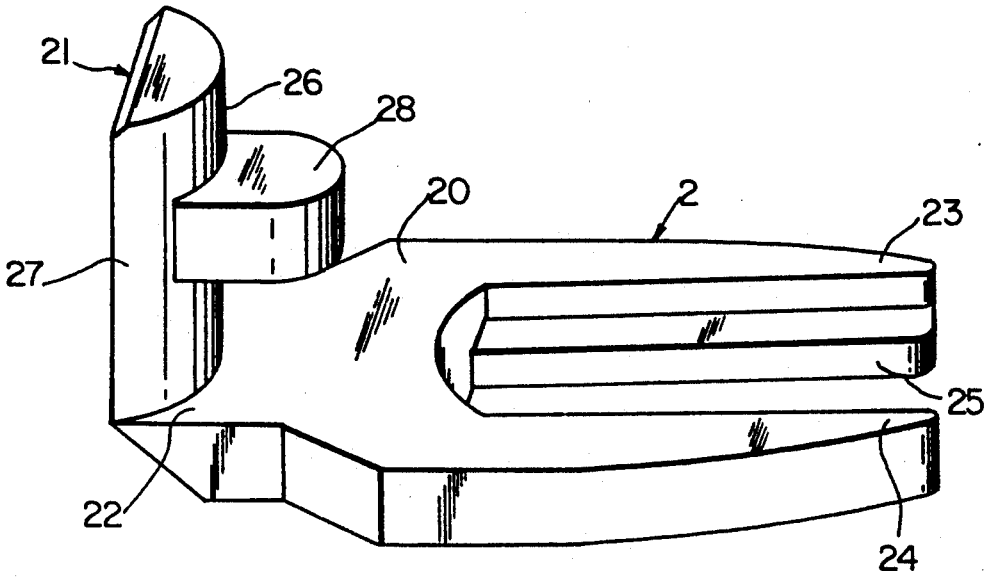
FIGS. 3*a* and 3*b* are perspective views of the movable intermediate piece shaped as a fork of the present system, respectively from top and from bottom.
Figure 3B:
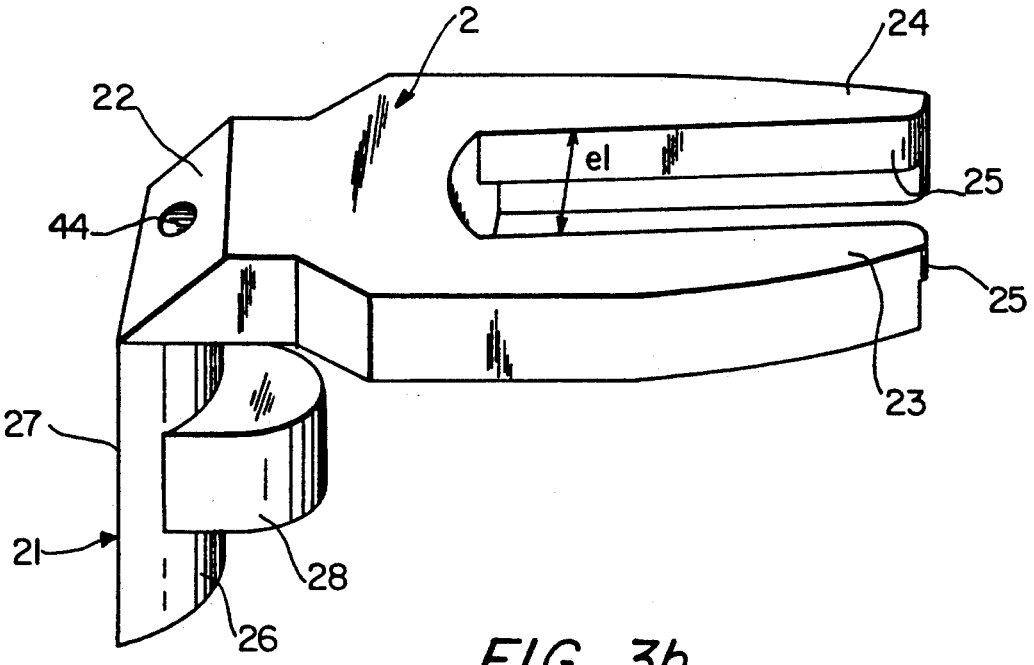

Referring now particularly to FIGS. 3*a* and 3*b*, it is shown that the movable intermediary fork piece (2), also molded in a metal such as "ZAMAK", comprises an horizontal fork, having the general numeral (20) and a vertical heel, having the general numeral (21).

As shown in FIG. 3*b*, fork (20) comprises a comparatively thick rear body (22) which is centrally bored to accommodate the screw mechanism (3) used to lock the fork (2) and to extract it when disassembling the system.

From said rear body (22) extend two arms (23), (24) forming a fork, each arm having a L cross section, the horizontal wings (25) of said arms being parallel one to another and being spaced by a distance e1 slightly larger than the distance e2 between the bottoms of grooves (9) and (10) of piece (1).

At the rear of body (22) extends vertically a semi-cylindrical heel (21) generally vertical, i.e. perpendicular to fork (23, 24), the front face of which (26) is convex and the rear face of which (27) is planar. As it will be described hereunder, the heel bulk as delimited by faces (26) and (27) is exactly received in a corresponding recess (30) of the plate P edge, the height of heel (21) being equal to the thickness of plate P.

To safely secure the position of heel (21) in said recess, an additional stud (28) extends form the front face (26) to be received in a corresponding hole (29) into the recess bottom.

The use of the present system will now be described in detail with reference to FIGS. 1 and 2, and also to FIG. 5.

To safely secure the position of plate P upon block A and maintain the same, shoe (1) is firstly fixed on the upper face F1 of block A by forcing studs (7) and (8) in their holes into the upper wall of block A, and, if needed, locking it by screwing a screw through said wall and into bore (11) of stud (7).

Shoe (1) provides then two parallel grooves (9, 10), precisely oriented perpendicularly to the plate P edge, for receiving the fork (23, 24) of piece (2), with the minimum clearance corresponding to the small difference between e1 and e2.

Fork (2) is therefore adapted to shoe (1) and plate P is thereafter adapted to shoe (1) and fork (2), by resting of lower face F2 of plate P upon the bearing plate (6) of shoe (1) and inserting heel (21) and its stud (28) into recess (30) of plate P edge and its hole (29).

The guiding of fork arms (23, 24) along grooves (9, 10) and the cooperation of heel (21) and its stud (28) with their corresponding recesses (30, 29) secure a precise and "fool-proof" positioning of plate P upon block A.

Figure 2:
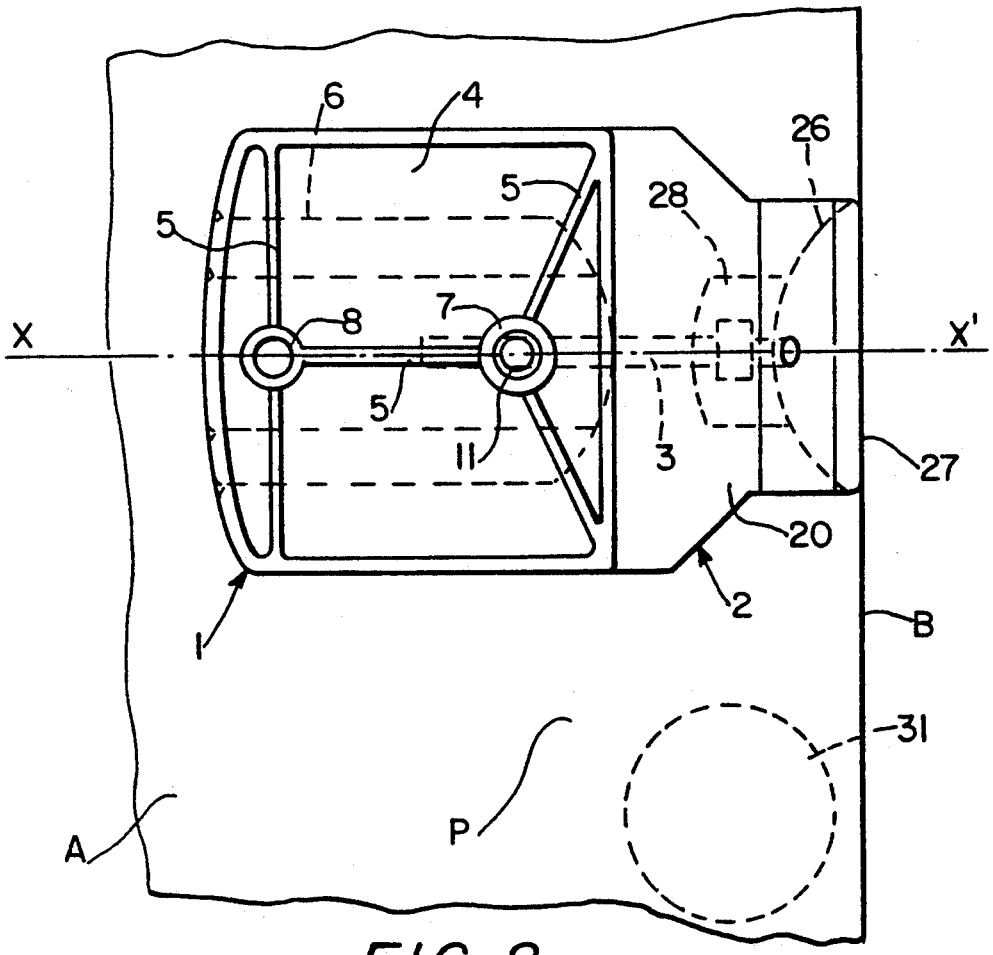
FIG. 2 is a view taken from the bottom, in direction II—II of FIG. 1.

As already mentioned, and as shown particularly on FIG. 2, the rear planar face (27) of heel (21) is precisely in the plane of vertical edge B of plate P, so that said edge does not visually show any break. The surface itself of the plate P does not contain any elements of the system and so is not adversely affected by the system, thereby providing an aesthetic furniture system. Further, the free space between upper face F1 of block A and lower face F2 of plate P, gives a lighter appearance to the plate/block assembly.

Taking into account said free space, to secure a proper stability for plate P, blocks of flexible material (31) are provided around the anchoring points so that plate P always rests upon at least four points.

As already mentioned, one major advantage of this system is the possible reversibility of the plate P, recesses (30) being provided along each edge thereof without prejudice to the surface which is turned up when resting upon block A.

Finally, although said system satisfactorily positions and maintains a plate upon a block, the invention further provides a screw mechanism for easy and safe locking of said system in place and extraction and removal of fork (2).

In fact, due to the precision of the system, when shoe (1) and fork (2) are assembled, heel (21) is so closely received in recess (30) that such a mechanism is required to disassemble fork (2) from shoe (1).

Said mechanism (3) is clearly demonstrated in FIG. 5 which is a partial vertical section through the symmetry plane of shoe (1) and fork (2) when assembled through a screw (40), extending horizontally therethrough from the hole (23) of the rear body (22) of fork (2).

The screw head (41) is axially immobile, being engaged by the rear wall of body (22) and a first unthreaded guiding lug (42), then screw (40) extends through a second unthreaded guiding lug (43) of body (22) and extends then out of body (22) to reach shoe (1) in which it screws in thread (13) thereof.

When, using a proper tool such as a screwdriver inserted through hole (23), the screw head (41) is rotated clockwise, screw 40 engages with thread (13) so that shoe (1) and fork (2) are caused to be closely connected, which locks the entire system with the rear face (27) of heel (21) on a level with the edge B of plate P.

In such relationship, it is impossible to grip the heel (21) out from its recess (30) in plate P, to disassemble the system. In order to remove heel (21) it is only needed to rotate screw (40) counter-clockwise to remove said screw from shoe (1) and fork (2) and extract heel (21) from recess (30).

It is well understood that this description is given as an illustrative example only and that various modifications can be developed within the scope of the claims, particularly regarding the shape of the elements.

As a example, whereas the rear lower edge of body (22) is shown as slanting downwardly, so that hole (23)

is not visible from outside, it is clear that said edge could be vertical, on a level with face (27) of heel (21).

I claim:

1. A fastener system for positioning and maintaining in place a horizontal plate upon a horizontal support surface, wherein the horizontal plate has top and bottom planar surfaces and a peripheral edge having a recess containing a hole, and the support surface has an upper horizontal surface containing first and second holes, said fastener comprising:

a shoe mountable on the upper horizontal surface of the support surface, said shoe having a horizontal upper bearing plate, a horizontal lower base plate, and a middle connecting portion connecting said lower base plate to said upper bearing plate, said lower base plate having a first stud extending downwardly therefrom aligned and configured to fit into the first hole of the support surface and a second stud extending downwardly therefrom aligned and configured to fit into the second hole of the support surface, said middle connecting portion having two vertical parallel sides defining with said upper bearing plate and said lower base plate a pair of grooves parallel to each other and to said horizontal surface of said support surface; and a movable fork having horizontal arms slidably engageable with said grooves of said shoe, a rear body extending perpendicularly from said arms, said rear body having a vertical semi-cylindrical heel having a planar rear face having a height equal to the thickness of said plate, a front face slidably connectable with said recess of said peripheral plate edge, and a stud extending perpendicularly from said front face, said stud being slidably connectable with said hole in said plate edge recess.

2. The fastener system of claim 1 further comprising a screw mechanism for locking said shoe and said fork in place, said screw mechanism comprising:

a horizontal threaded bore formed in said middle connecting portion of said shoe parallel to said grooves;

a horizontal central bore formed in said rear body of said fork; and a screw extending horizontally through said bore of said rear body of said fork and into said threaded bore of said middle connecting portion of said shoe.

3. The fastener system of claim 1, wherein the diameter of said first stud of said shoe is greater than that of said second stud of said shoe and said first stud contains an internal bore for receiving a screw.

4. The fastener system of claim 1, wherein said front face of said heel of said rear body is semi-cylindrical and is complementary in shape to the recess in the horizontal plate.

5. A reversible modular furniture system comprising:

a plate having top and bottom planar surfaces and a peripheral edge having a recess containing a hole;

a support surface having an upper horizontal surface containing first and second holes;

and a fastener system for removably connecting said plate to said support surface with either said top planar surface or said bottom planar surface facing said support surface, said fastener system comprising:

a shoe mountable on said upper horizontal surface of said support surface, said shoe having a horizontal upper bearing plate, a horizontal lower base plate, and a middle connecting portion connecting said lower base plate to said upper bearing plate, said lower base plate having a first stud extending downwardly therefrom aligned and configured to fit into said first hole of said support surface and a second stud extending downwardly therefrom aligned and configured to fit into said second hole of said support surface, said middle connecting portion having two vertical parallel sides defining with said upper bearing plate and said lower base plate a pair of grooves parallel to each other and to said horizontal surface of said support surface; and a moveable fork having horizontal arms slidably engageable with said grooves of said shoe, a rear body extending perpendicularly from said arms, said rear body having a vertical semi-cylindrical heel having a planar rear face having a height equal to the thickness of said plate, a front face slidably connectable with said recess of said peripheral plate edge, and a stud extending perpendicularly from said front face, said stud being slidably connectable with said hole in said plate edge recess.

6. The modular furniture system of claim 5, said fastener system further comprising a screw mechanism for locking said shoe and said fork in place, said screw mechanism comprising a screw extending horizontally through said bore of said fork rear body and into said threaded bore of said shoe middle connecting portion.

7. The modular furniture system of claim 5, wherein the diameter of said first stud of said shoe is greater than that of said second stud of said shoe and said first stud contains an internal bore for receiving a screw.

8. The modular furniture system of claim 5, wherein said front face of said heel of said rear body is semi-cylindrical and is complementary in shape to said recess in said plate.

* * * * *